US011192736B2

(12) United States Patent
Okada

(10) Patent No.: US 11,192,736 B2
(45) Date of Patent: Dec. 7, 2021

(54) IMAGE FORMING DEVICE

(71) Applicant: KYOCERA Document Solutions Inc., Osaka (JP)

(72) Inventor: Masanori Okada, Osaka (JP)

(73) Assignee: KYOCERA Document Solutions Inc.

( * ) Notice: Subject to any disclaimer, the term of this patent is extended or adjusted under 35 U.S.C. 154(b) by 218 days.

(21) Appl. No.: 16/544,100

(22) Filed: Aug. 19, 2019

(65) Prior Publication Data

US 2020/0055682 A1 Feb. 20, 2020

(30) Foreign Application Priority Data

Aug. 20, 2018 (JP) ..... JP2018-153960

(51) Int. Cl.

| | |
|---|---|
| ***B65H 5/36*** | (2006.01) |
| ***B65H 3/10*** | (2006.01) |
| ***B65H 3/14*** | (2006.01) |
| ***B65H 5/22*** | (2006.01) |

(52) U.S. Cl.

CPC ..... *B65H 3/10* (2013.01); *B65H 3/14* (2013.01); *B65H 5/222* (2013.01); *B65H 5/224* (2013.01); *B65H 5/36* (2013.01); *B65H 2301/44336* (2013.01); *B65H 2406/362* (2013.01)

(58) Field of Classification Search

CPC .... B65H 5/36; B65H 5/222; B65H 2406/351; B65H 2406/362; B65H 2404/6551; B65H 2404/6552; B65H 2301/44336

See application file for complete search history.

(56) References Cited

U.S. PATENT DOCUMENTS

| | | | | |
|---|---|---|---|---|
| 4,168,829 | A * | 9/1979 | Wilson | B65H 3/10 271/108 |
| 7,988,150 | B2 * | 8/2011 | Harney | H04N 1/121 271/276 |
| 9,434,186 | B2 * | 9/2016 | Gracia Verdugo | B41J 11/005 |
| 2011/0248441 | A1 * | 10/2011 | Yamada | B41J 11/06 271/11 |
| 2011/0292145 | A1 * | 12/2011 | Hoover | B41J 11/06 347/104 |
| 2018/0170073 | A1 * | 6/2018 | Barberan Latorre | B41J 3/28 |

FOREIGN PATENT DOCUMENTS

| | | | |
|---|---|---|---|
| JP | 2002205855 | A * | 7/2002 |
| JP | 2005-067105 | | 3/2005 |

* cited by examiner

*Primary Examiner* — Howard J Sanders
(74) *Attorney, Agent, or Firm* — Gerald E. Hespos; Michael J. Porco; Matthew T. Hespos

(57) ABSTRACT

An image forming device includes an image forming unit to form an image on a work, a conveyance unit to convey the work in a predetermined conveyance direction, a conveyance guide member, a suction unit, and a suction control unit. The conveyance guide member is a plate-shaped member which has a plurality of suction holes and guides conveyance of the work by the conveyance unit from below. The suction unit includes a suction device which generates suction air by sucking air in a space on an upper side of the conveyance guide member via the plurality of suction holes, and closely contacts the work to the conveyance guide member by the suction air. The suction control unit changes a sucking force of the suction device according to a length in the work width direction of the work guided by the conveyance guide member.

3 Claims, 8 Drawing Sheets

IMAGE FORMING DEVICE

The present application claims priority from Japanese Patent Application No. 2018-153960 filed on Aug. 20, 2018, disclosure of which is all incorporated herein by reference.

BACKGROUND

Field of the Invention

The present disclosure relates to an image forming device to form an image on a predetermined work.

Related Art

For example, in an ink jet printer as an image forming device to form an image on a predetermined work, a liquid ejecting head (a printing unit) which ejects a minute amount of ink (liquid) to a printing target is used. When a work is conveyed in a predetermined conveyance direction and a liquid ejecting head ejects ink while reciprocating to move in a scan direction orthogonal to the conveyance direction, characters and images are formed on the work.

A conventional ink jet printer includes a platen (a conveyance guide member) which has a plurality of suction holes and guides conveyance of a work from below, and a suction device which sucks air in a space on an upper side of the platen via the plurality of suction holes to make the work closely adhere to the platen.

As a work to be printed by a printer, various kinds of works with different widths are used. In a case, for example, where a wide work is used which has a width corresponding to an entire region of a platen in a width direction, the platen which guides conveyance of a work from below has all of the suction holes covered with the work. By contrast, in a case where a narrow work is used which has a width corresponding to a part of the platen in the width direction, the platen which guides conveyance of a work from below has a part of the suction holes covered with the work. In other words, a range of the suction holes covered with the work in the width direction of the platen changes with the width of the work.

SUMMARY

An image forming device according to one aspect of the present disclosure includes an image forming unit to form an image on a predetermined work, a conveyance unit, a conveyance guide member, a suction unit, and a suction control unit. The conveyance unit conveys the work in a predetermined conveyance direction toward the image forming unit. The conveyance guide member is formed to have a plate shape with a predetermined length in a work width direction orthogonal to the conveyance direction of the work, has a plurality of suction holes provided over an entire region in the work width direction, and guides conveyance of the work by the conveyance unit from below. The suction unit includes a suction device which is arranged below the conveyance guide member and generates suction air by sucking air in a space on an upper side of the conveyance guide member via the plurality of suction holes, the suction unit closely adhering the work to the conveyance guide member by the suction air. The suction control unit changes a sucking force of the suction device according to a length in the work width direction of the work guided by the conveyance guide member.

DETAILED DESCRIPTION

Figure 1:
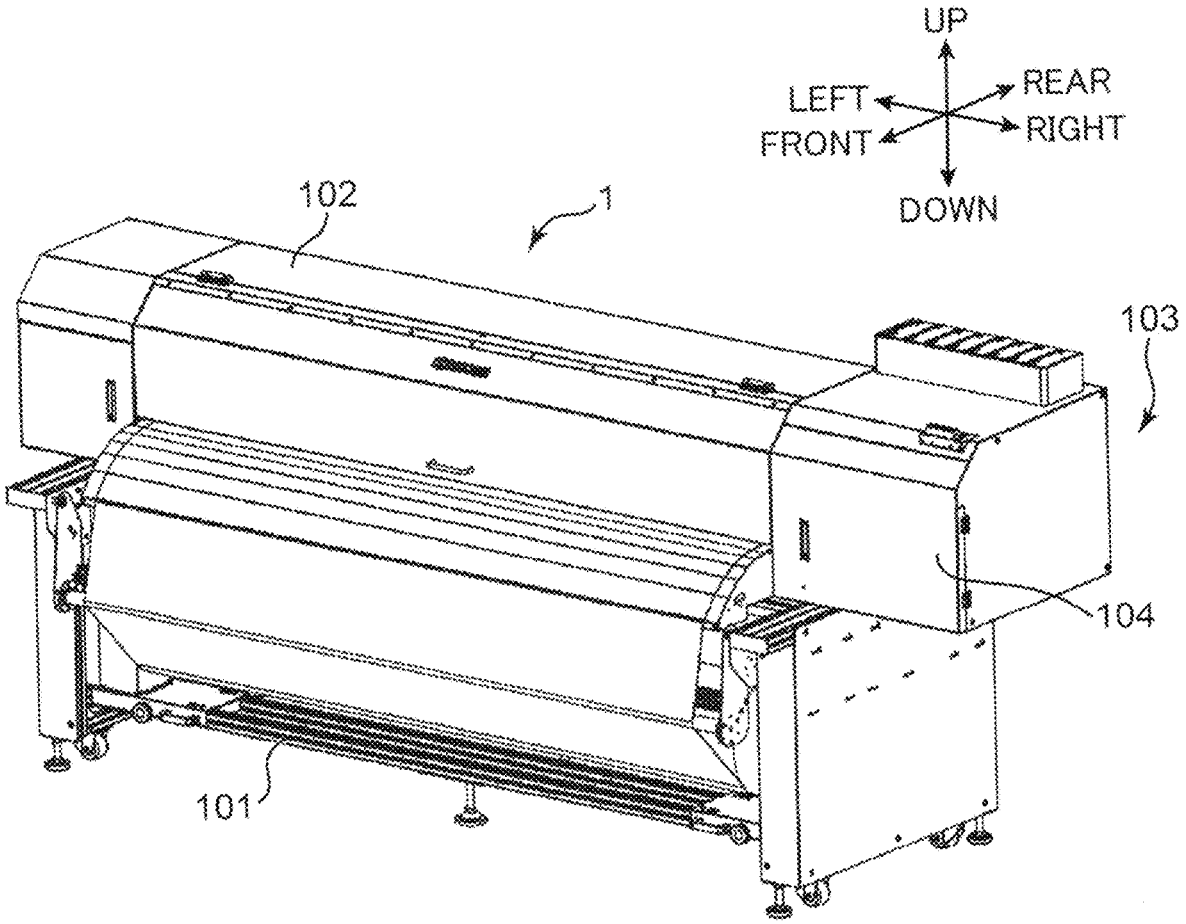
FIG. 1 is a perspective view showing an appearance of an image forming device according to one embodiment of the present disclosure.
Figure 2:
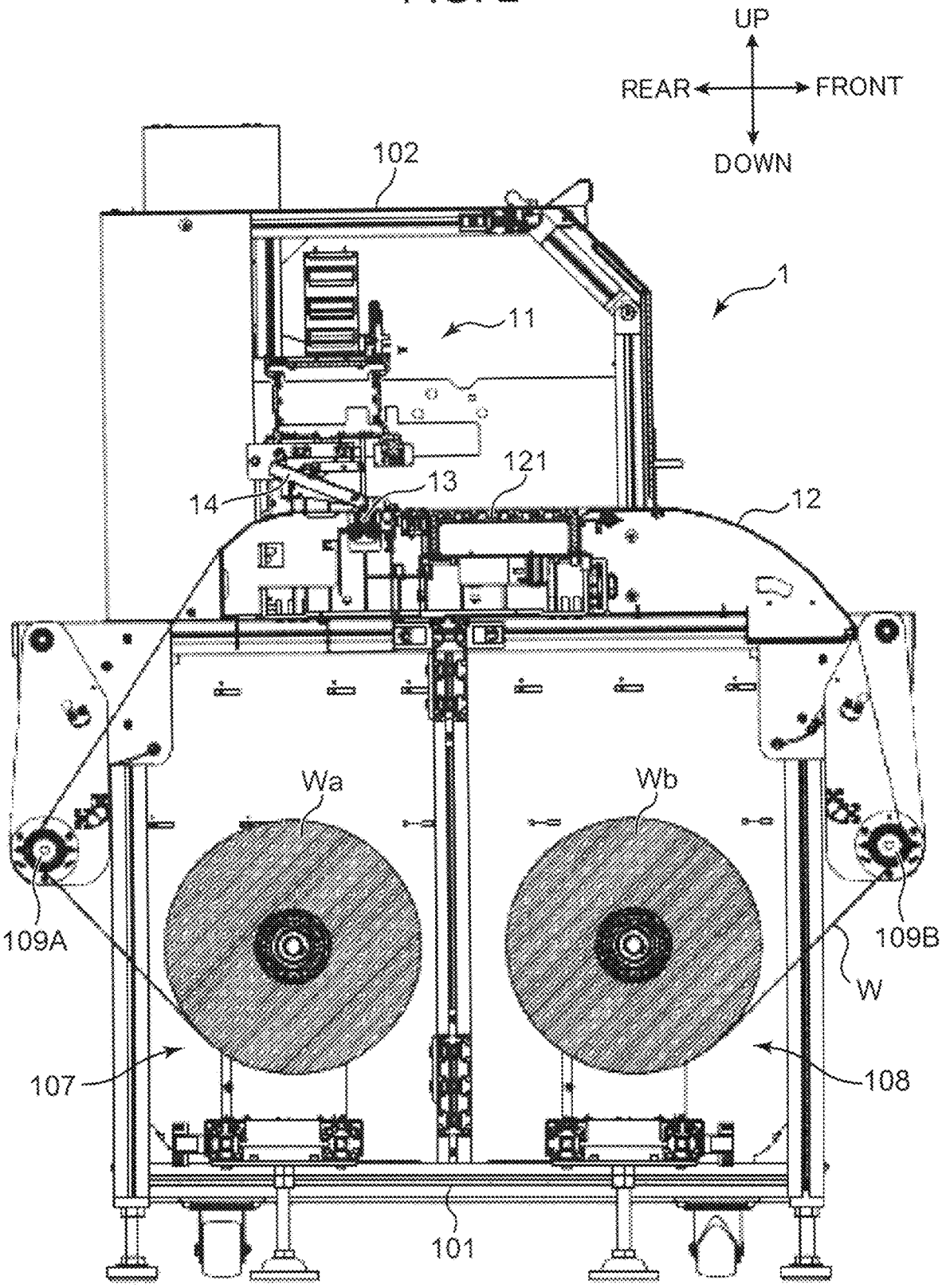
FIG. 2 is a sectional view of the image forming device.
Figure 3:
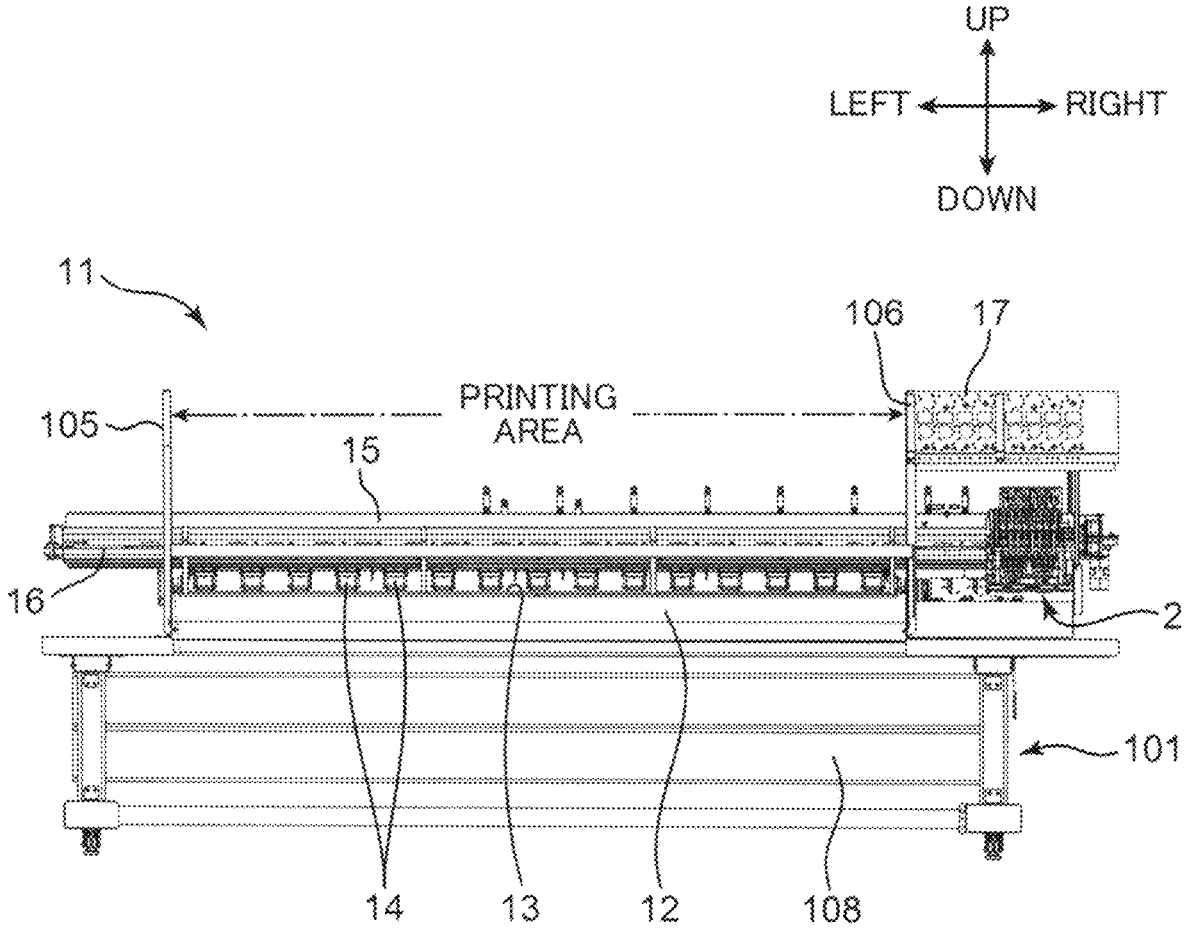
FIG. 3 is a front view of the image forming device with an outer cover removed.
Figure 4:
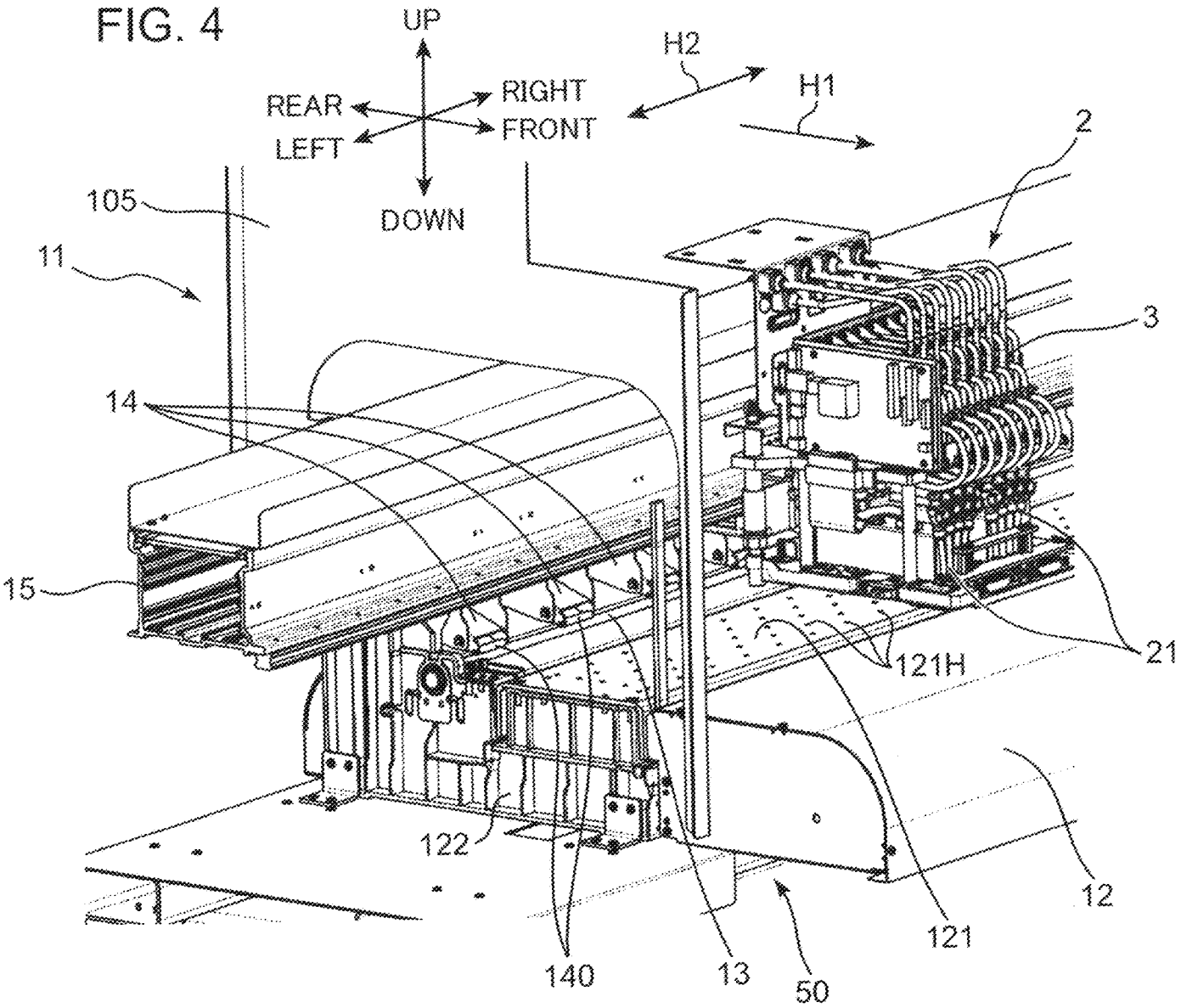
FIG. 4 is a perspective view showing a part of the image forming device with the outer cover removed in an enlarged manner.
Figure 5:
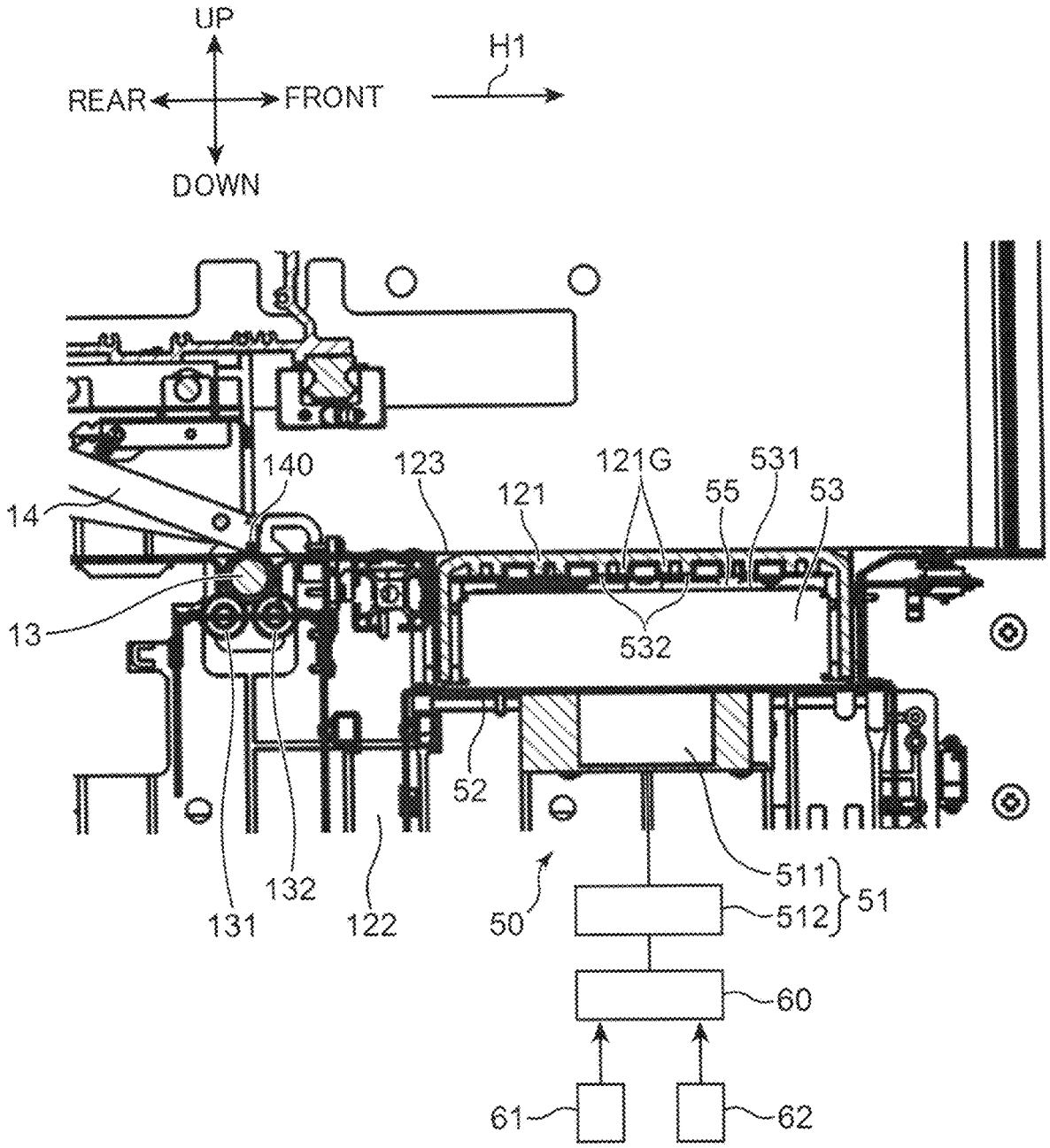
FIG. 5 is a sectional view showing the proximity of a suction unit in the image forming device in an enlarged manner.

In the following, an image forming device according to an embodiment of the present disclosure will be described with reference to the drawings. FIG. 1 is a perspective view showing an appearance of an image forming device 1 according to one embodiment of the present disclosure and FIG. 2 is a sectional view of the image forming device 1. FIG. 3 is a front view of the image forming device 1 with an outer cover 102 removed and FIG. 4 is a perspective view showing a part of the image forming device 1 with the outer cover 102 removed in an enlarged manner. FIG. 5 is a sectional view showing the proximity of a suction unit 50 in the image forming device 1 in an enlarged manner. Although in FIGS. 1 to 5 and the following figures, front and rear, right and left, and up and down directions are indicated, these directions are used for explanation's sake only and not construed to limit the direction.

Overall Configuration of Image Forming Device

The image forming device 1 is an image forming device which conducts printing processing such as printing and photo printing of various kinds of works W having various kinds of sizes such as paper sheet, resin sheet, or cloth by ink ejecting and is in particular suitable for printing processing of a long work W of a large size. The image forming device 1 includes a base frame 101 with a caster, and a device main body 11 which is placed on the base frame 101 and executes the printing processing (image forming operation).

The device main body 11 includes a work conveyance path 12, a conveyance roller 13, a plurality of pinch roller units 14, a carriage 2, and the suction unit 50. The work conveyance path 12 is a conveyance path which extends in a front-rear direction and carries the work W to be subjected to printing processing from a rear side into the device main body 11 and carries out the work W from a front side.

The conveyance roller 13 is a conveyance unit which extends in a right and left direction and generates a driving force for intermittently sending the work W on the work conveyance path 12. In other words, the conveyance roller 13 is rotated around a predetermined axis extending in the right and left direction to convey the work W to a forward direction (a predetermined conveyance direction H1) such that the work W passes an image formation position opposed to a head unit 21 (an image forming unit). With reference to FIGS. 4 and 5, the conveyance roller 13 is supported from below by a first bearing 131 and a second bearing 132 attached to frames 122 fixed to both ends of a suction casing 52 which will be described later in the right and left direction. The first bearing 131 and the second bearing 132 assist rotation of the conveyance roller 13 by supporting the conveyance roller 13 from below.

The pinch roller unit 14 includes a pinch roller 140 which is arranged so as to be opposed to the conveyance roller 13 from above and forms a conveyance nip portion with the conveyance roller 13. A plurality of the pinch roller units 14 are arranged at predetermined intervals in the right and left direction along the conveyance roller 13. The respective pinch rollers 140 that the plurality of pinch roller units 14 respectively have are rotatably arranged along the conveyance roller 13 to form the conveyance nip portion which sandwiches the work W with the conveyance roller 13. The plurality of pinch roller units 14 each hold the pinch roller 140 and are capable of adjusting a nip pressure of the pinch roller 140 with respect to the conveyance roller 13.

The carriage 2 is a movable body on which a unit that conducts printing processing of the work W is mounted and which is capable of reciprocating to move along the right and left direction on the base frame 101. On an upper side of the base frame 101, a carriage guide 15 provided with a guide rail for guiding the reciprocation movement of the carriage 2 is disposed to extend in the right and left direction. To the carriage guide 15, a timing belt 16 is attached to be capable of circulating in the right and left direction. The carriage 2 has a fixing unit to the timing belt 16 and moves in the right and left direction while being guided by the guide rail following forward rotation or reverse rotation of the circular movement of the timing belt 16.

The printing processing is executed in such a manner that the conveyance roller 13 and the pinch roller unit 14 intermittently send the work W and during stop of the work W, the carriage 2 moves in the right and left direction to print-scan the work W.

In the work conveyance path 12, a platen 121 is arranged under a passage of the carriage 2, as a conveyance guide member which guides conveyance of the work W by the conveyance roller 13 from below as shown in FIG. 4. Specifically, an image formation position for the work W is arranged on the platen 121. The platen 121 is formed to have a plate shape with a predetermined length in a work width direction H2 (the right and left direction) orthogonal to the conveyance direction H1 of the work W, and has a plurality of suction holes 121H provided over the entire region in the work width direction H2.

The suction unit 50 is arranged below the platen 121 as shown in FIGS. 4 and 5. The suction unit 50 generates suction air by sucking air in a space on the upper side of the platen 121 via the plurality of suction holes 121H and closely adheres the work W to the platen 121. During the printing processing, with the work W closely adhered to the platen 121 by the suction air generated by the suction unit 50, the carriage 2 executes print scanning. Detailed configuration of the suction unit 50 will be described later.

The device main body 11 is covered with the outer cover 102. A side station 103 is arranged in a right side region of the outer cover 102. An immovable ink cartridge rack 17 is housed in the side station 103, the ink cartridge rack holding an ink cartridge (not shown) which stores ink for printing processing.

A front part of the side station 103 is a carriage saving area 104 as a saving space of the carriage 2. As shown in FIG. 3, a left frame 105 and a right frame 106 stand on the base frame 101 at an interval corresponding to the work conveyance path 12 in the right and left direction. An area between the left and right frames 105 and 106 is set to be a printing area in which the printing processing can be executed. The carriage guide 15 has a right and left width larger than that of the printing area, so that the carriage 2 can be moved to the outer side of the right side of the printing area. When no printing processing is executed, the carriage 2 is saved in the carriage saving area 104.

On the rear side of the base frame 101, a feeding unit 107 is provided which houses a feeding roll Wa as a roll of the work W that is a target of the printing processing. The feeding unit 107 sends out the work W while applying a predetermined tension to the work W by a tension roller 109A. On the front side of the base frame 101, a wind-up unit 108 is provided which houses a wound-up roll Wb as a roll of the work W having been subjected to the printing processing. The wind-up unit 108, which is provided with a driving source not shown that drives to rotate a wind-up shaft of the wound-up roll Wb, winds up the work W while applying a predetermined tension to the work W by a tension roller 109B.

As shown in FIG. 4, there are mounted on the carriage 2 the head unit 21 which ejects ink to the work W to form an image and a liquid supply unit 3 which supplies ink from the ink cartridge to the head unit 21. FIG. 4 shows an example in which two head units 21 and eight liquid supply units 3 are mounted on the carriage 2. Specifically, four liquid supply units 3 are provided for supplying each ink of cyan, magenta, yellow, and black for one head unit 21. The carriage 2 conducts reciprocation movement in the right and left direction along the carriage guide 15. Each liquid supply unit 3 may be charged with a different color ink and a maximum of eight color inks may be ejected from the two head units 21.

Detailed Configuration of Suction Unit

Figure 6:
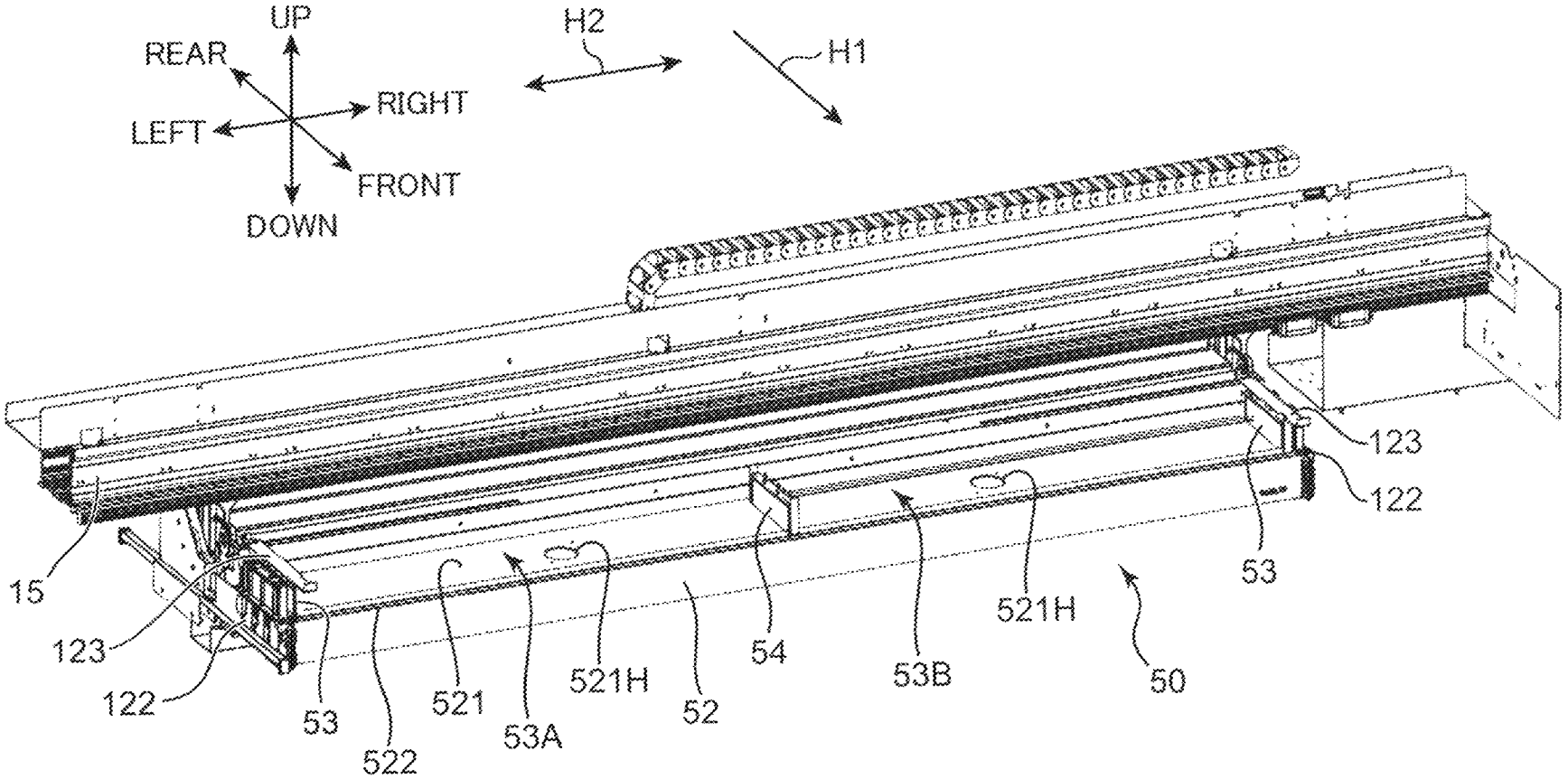
FIGS. 6 and 7 are perspective views each showing the proximity of the suction unit in the image forming device.
Figure 7:
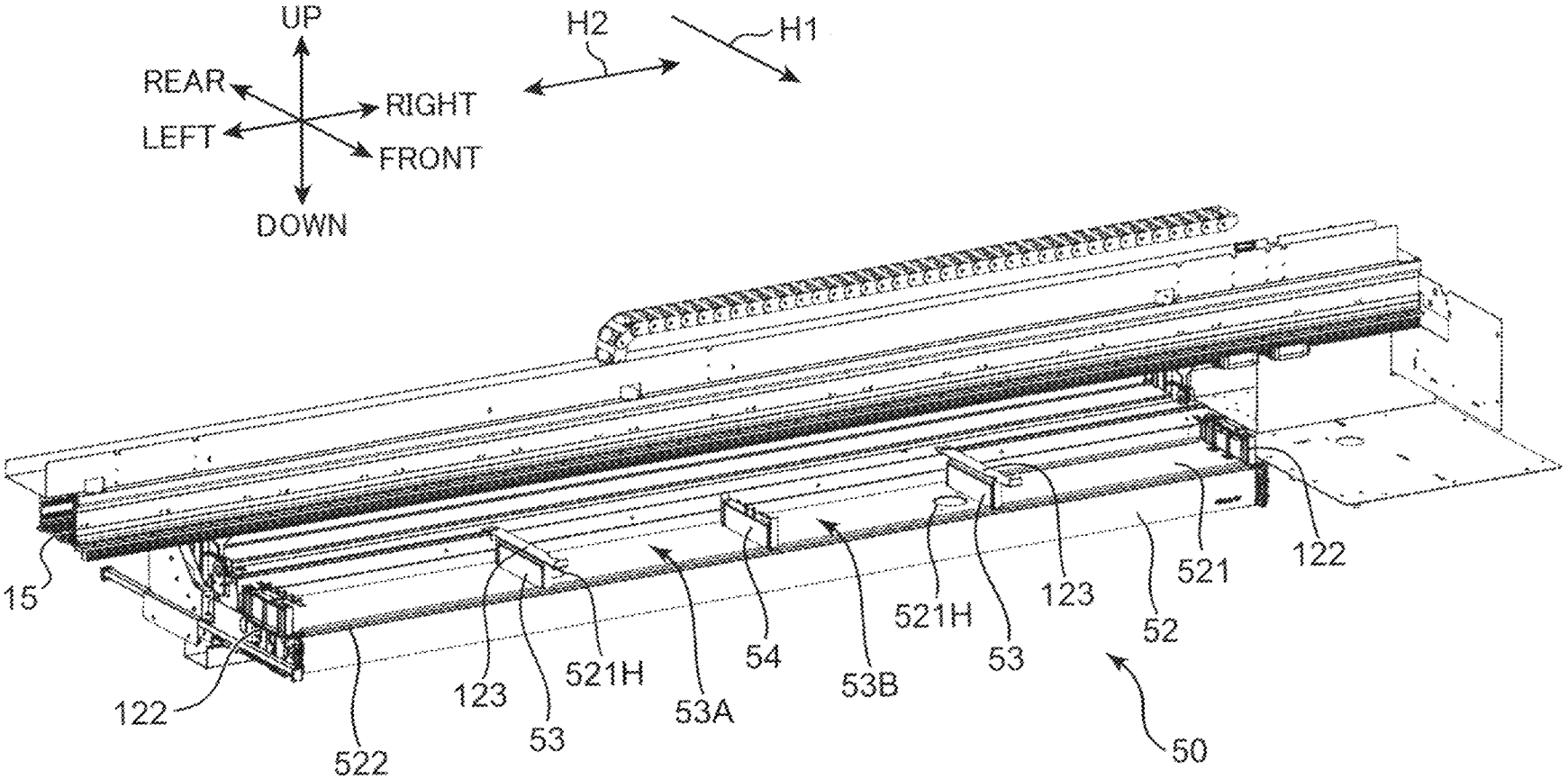
Figure 8:
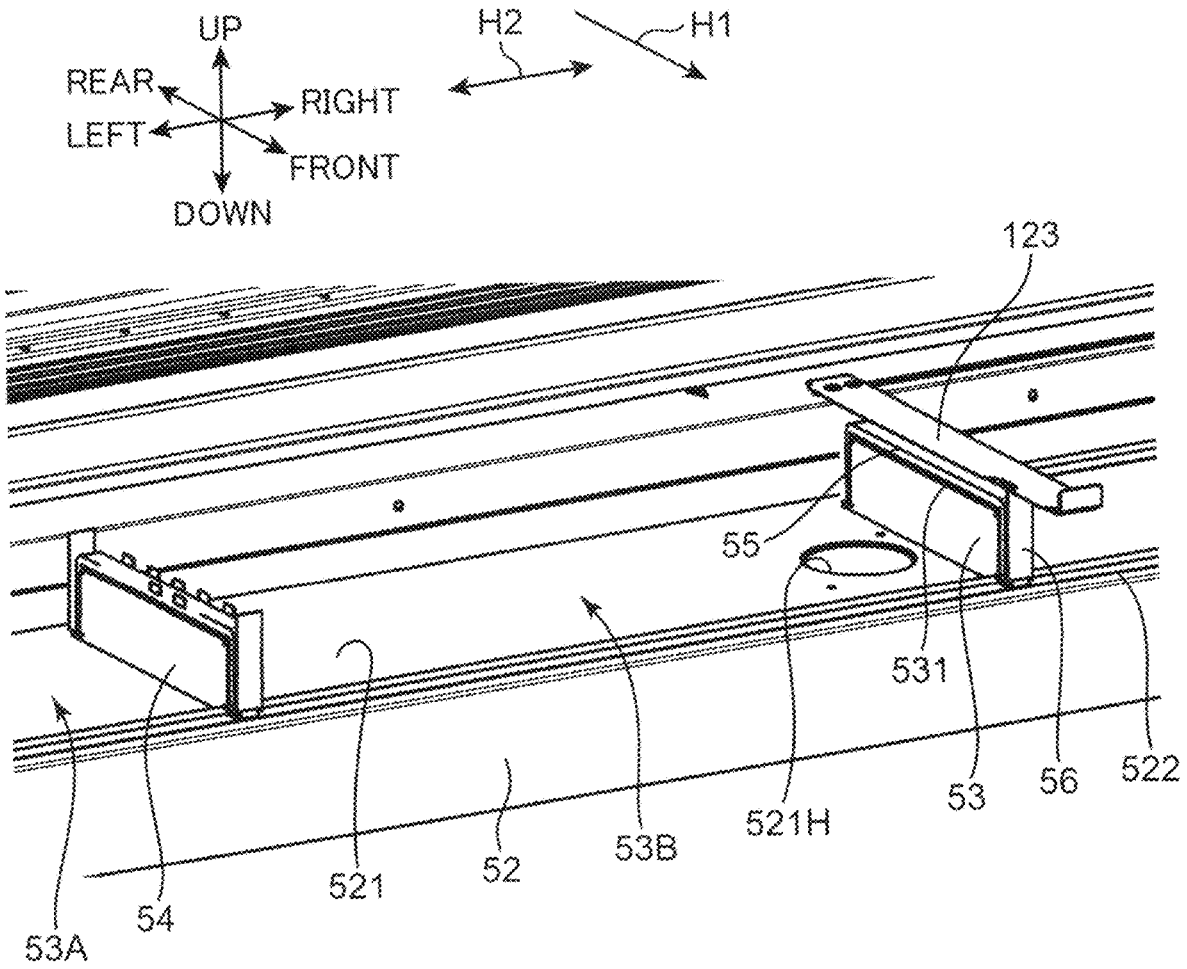
FIG. 8 is a perspective view showing the proximity of a movable board in the suction unit in an enlarged manner.

Next, a configuration of the suction unit 50 provided in the image forming device 1 will be described with reference to FIGS. 6 to 8 in addition to FIGS. 4 and 5. FIGS. 6 and 7 are perspective views each showing the proximity of the suction unit 50 in the image forming device 1, the perspective views each showing a state where the platen 121 is removed. FIG. 8 is a perspective view showing the proximity of a pair of movable boards 53 in the suction unit 50 in an enlarged manner, the perspective view showing a state where the platen 121 is removed.

The suction unit 50 is a mechanism which generates suction air for closely adhering the work W to the platen 121 which guides conveyance of the work W from below during the printing processing by the image forming device 1. The suction unit 50 is arranged below the platen 121 to generate suction air by sucking air in the space on the upper side of the platen 121 via the plurality of suction holes 121H of the platen 121. The suction unit 50 includes a suction device 51 which generates suction air, the suction casing 52 formed to have a box shape capable of housing the suction device 51, the pair of movable boards 53, and a fixing plate 54.

The suction device 51 includes a suction fan 511 arranged in the suction casing 52 and rotating to generate suction air, and a fan motor 512 as a driving source for rotating the suction fan 511. The number of the suction devices 51 in the suction casing 52 is not particularly limited but may be one or plural. In the present embodiment, two suction devices 51 are arranged at a predetermined interval in the work width direction H2 in the suction casing 52. In each suction device 51, the fan motor 512 controlled by a suction control unit 60 to be described later is driven to rotate, thereby rotating the suction fan 511 to generate suction air. The fan motor 512 and the suction fan 511 may be integrally configured.

The suction casing 52 is a box-shaped casing having an internal space and a rectangular solid-shaped appearance. The suction casing 52 has an upper surface member 521 which has substantially the same length as the platen 121 in the work width direction H2 and is covered with the platen 121 from the upper side. In other words, the suction casing 52 and the platen 121 are substantially the same in length in the work width direction H2 and the entire region of the upper surface member 521 of the suction casing 52 is covered with the platen 121 from the upper side.

In the upper surface member 521 of the suction casing 52, suction openings 521H are formed which allow suction air generated by the suction device 51 arranged in the suction casing 52 to pass. In the present embodiment, two suction openings 521H are formed at a predetermined interval in the work width direction H2 on the upper surface member 521 of the suction casing 52 as shown in FIGS. 6 and 7. In the suction casing 52, the suction device 51 is arranged such that the suction fan 511 is positioned directly under the suction opening 521H. Additionally, a guide groove 522 is formed at a front edge of the upper surface member 521 of the suction casing 52. The guide groove 522 guides movement of the pair of movable boards 53 to be described later.

The fixing plate 54 is a plate body fixed to the upper surface member 521 between the platen 121 and the upper surface member 521 of the suction casing 52. As shown in FIGS. 6 and 7, the fixing plate 54 is arranged at a central position of the upper surface member 521 of the suction casing 52 in the work width direction H2 so as to be sandwiched between the two suction openings 521H.

The pair of movable boards 53 is a plate body provided between the platen 121 and the upper surface member 521 of the suction casing 52 so as to be movable in the work width direction H2 along the guide groove 522 of the upper surface member 521. The movable boards 53 in pair are arranged on the upper surface member 521 of the suction casing 52 in opposed relation to each other so as to sandwich the fixing plate 54. In other words, one movable board 53 of the pair of movable boards 53 is opposed, at a left side of the fixing plate 54, to the fixing plate 54 and the other movable board 53 is opposed, at a right side of the fixing plate 54, to the fixing plate 54.

The pair of movable boards 53 is set to be movable in the work width direction H2 in association with a pair of cursors 123 arranged on the platen 121. Here, the pair of cursors 123 is a cursor for adjusting a width of the work W. The cursors 123 in pair are arranged to be opposed to each other in the work width direction H2 on the platen 121. The pair of cursors 123 is provided to be movable in the work width direction H2 on the platen 121 and positions the work W whose conveyance is guided by the platen 121 in the work width direction H2.

The pair of movable boards 53 moves in the work width direction H2 between the platen 121 and the upper surface member 521 of the suction casing 52 in association with the pair of cursors 123. By this movement, the pair of movable boards 53 defines a first suction space 53A and a second suction space 53B between the platen 121 and the upper surface member 521. The first suction space 53A is a space divided by the left side movable board 53 of the pair of movable boards 53 and the fixing plate 54 between the platen 121 and the upper surface member 521 of the suction casing 52. The first suction space 53A forms a suction space through which suction air flows via among the plurality of suction holes 121H formed in the platen 121, the suction hole 121H in a range between the left side movable board 53 and the fixing plate 54 and via the suction opening 521H formed, on the left side of the fixing plate 54, in the upper surface member 521 of the suction casing 52. On the other hand, the second suction space 53B is a space divided by the right side movable board 53 of the pair of movable boards 53 and the fixing plate 54 between the platen 121 and the upper surface member 521 of the suction casing 52. The second suction space 53B forms a suction space through which suction air flows via among the plurality of suction holes 121H formed in the platen 121, the suction hole 121H in a range between the right side movable board 53 and the fixing plate 54 and via the suction opening 521H formed, on the right side of the fixing plate 54, in the upper surface member 521 of the suction casing 52.

As shown in FIG. 8, the pair of movable boards 53 is set to be movable in association with the pair of cursors 123 with the pair of movable boards 53 fixed to the pair of cursors 123 by a connection member 56. A range where the left side movable board 53, among the pair of movable boards 53, is allowed to move in the work width direction H2 along the guide groove 522 in the upper surface member 521 of the suction casing 52 is from a left end of the upper surface member 521 to a position before the left side suction opening 521H (see FIG. 7). A range where the right side movable board 53, among the pair of movable boards 53, is allowed to move in the work width direction H2 along the guide groove 522 in the upper surface member 521 of the suction casing 52 is from a right end of the upper surface member 521 to a position before the right side suction opening 521H (see FIG. 7).

As described in the foregoing, in the image forming device 1 according to the present embodiment, movement of the pair of movable boards 53 in association with the pair of cursors 123 for adjusting the width of the work W enables the first suction space 53A and the second suction space 53B in which suction air flows between the platen 121 and the upper surface member 521 of the suction casing 52 to be defined, according to the width of the work W. This enables regulation of passage of suction air via the suction hole 121H arranged in a range not covered with the work Win a width direction of the platen 121 (the same direction as the work width direction H2), so that reduction in suction efficiency can be suppressed.

As shown in FIGS. 5 and 8, the suction unit 50 can be also configured to include a sealing member 55. The sealing member 55 is formed of an elastically deformable elastic body. Attachment of the sealing member 55 to opposed surfaces 531 of the pair of movable boards 53, the opposed surfaces 531 being opposed to the platen 121, enables the first suction space 53A and the second suction space 53B to be sealed which are defined by the pair of movable boards 53 between the platen 121 and the upper surface member 521 of the suction casing 52.

Additionally, as shown in FIG. 5, the pair of movable boards 53 can be configured to have an engagement recessed member 532 formed in the opposed surface 531, and the platen 121 can be configured to have an engagement projected member 121G which engages with the engagement recessed member 532. Engagement between the engagement recessed member 532 and the engagement projected member 121G enables the position of the pair of movable boards 53 to be maintained in a stand-up state between the platen 121 and the upper surface member 521 of the suction casing 52.

Control of Sucking Force of Suction Device

The image forming device 1 according to the present embodiment further includes the suction control unit 60, a detection unit 61, and an operation unit 62 as shown in FIG. 5.

The suction control unit 60 changes a sucking force of the suction device 51 according to a length (the width of the work W) along the work width direction H2 of the work W whose conveyance is guided by the platen 121. In the present embodiment, the suction control unit 60 changes the sucking force of the suction device 51 according to a position of the pair of cursors 123 on the platen 121 in the work width direction H2. Specifically, the suction control unit 60 changes the sucking force of the suction device 51 by controlling the number of rotations of the suction fan 511 of the suction device 51 per unit time, that is, the number of rotations of the fan motor 512 which causes the suction fan 511 to rotate.

The position of the pair of cursors 123 to be referred to by the suction control unit 60 when a sucking force of the suction device 51 is changed may be based on a detection result of the detection unit 61 or based on a set value related to the width of the work W (the length in the work width direction H2) which is input by user's operation of the operation unit 62. The detection unit 61 is a sensor which detects the position, in the work width direction H2, of the pair of cursors 123 on the platen 121.

The volumes of the first suction space 53A and the second suction space 53B defined by the pair of movable boards 53 between the platen 121 and the upper surface member 521 of the suction casing 52 change with movement of the pair of movable boards 53 in association with the pair of cursors 123 according to the width of the work W (the length of the work width direction H2). In other words, in the width direction of the platen 121 (the same direction as the work width direction H2), a ratio of the suction holes 121H arranged in the range covered with the work W to all the suction holes 121H (hereinafter referred to as "suction hole covering ratio") changes with the movement of the pair of movable boards 53 according to the width of the work W. Therefore, close contact of the work W to the platen 121 caused by suction air might change according to the width of the work W, the suction air being generated by the suction device 51 to flow in the first suction space 53A and the second suction space 53B via the suction holes 121H and the suction openings 521H.

Description will be made, as an example, of two kinds of works W, a wide work W having a first width (e.g. 1900 mm) and a narrow work W having a second width (e.g. 950 mm) which is half the first width.

In a case where in the width direction of the platen 121, the suction hole covering ratio when the wide work W is used is set to be "100%", the suction hole covering ratio when the narrow work W is used is "50%". Therefore, in a case where the suction fan 511 of the suction device 51 is rotated a fixed number of times, when the narrow work W is used, a sucking force obtained by suction air generated by the suction device 51 is double that obtained when the wide work W is used. When the work W is closely adhered to the platen 121 by the double sucking force, a conveyance load of the work W on the platen 121 is doubled, and therefore, a work W conveyance failure might occur. Poor image quality on the work W might also occur due to the conveyance failure.

Under these circumstances, the suction control unit 60 changes a sucking force of the suction device 51 based on a position of the pair of cursors 123 on the platen 121 according to the width of the work W, the pair of cursors 123 moving in association with the pair of movable boards 53 which defines the first suction space 53A and the second suction space 53B. For example, in a case where the wide work W having the suction hole covering ratio on the platen 121 of "100%" is used, when the pair of cursors 123 is moved according to the width of the work W, the number of rotations of the fan motor 512 is set to be a first number of rotations (e.g. 6000 rotations). By contrast, in a case where the narrow work W having the suction hole covering ratio on the platen 121 of "50%" is used, when the pair of cursors 123 is moved according to the width of the work W, the number of rotations of the fan motor 512 is changed to a second number of rotations (e.g. 3000 rotations) which is half the first number of rotations.

As described above, by changing a sucking force of the suction device 51 based on a position of the pair of cursors 123 for adjusting the width of the work W, the pair of cursors 123 moving in association with the pair of movable boards 53, it is possible to make close contact of the work W to the platen 121 constant according to the width of the work W while suppressing a sucking force from becoming excessive. It is therefore possible to suppress a conveyance failure of the work W caused by a change of close contact to the platen 121 and resultant reduction in image quality.

Modification Related to Control of Sucking Force of Suction Device

Although the above embodiment has been described with respect to the configuration in which the pair of movable boards 53 is provided between the platen 121 and the upper surface member 521 of the suction casing 52, the pair of movable boards defining the first suction space 53A and the second suction space 53B in which suction air flows, the present disclosure is not limited thereto. The suction unit 50 may not include but omit the pair of movable boards 53.

In the image forming device 1 in which the pair of movable boards 53 is omitted, the first suction space 53A and the second suction space 53B are defined between the platen 121 and the upper surface member 521 of the suction casing 52 by the frame 122 fixed to both ends of the suction casing 52 in the right and left direction and by the fixing plate 54. The first suction space 53A forms a space divided by the frame 122 fixed to the left end of the suction casing 52 and the fixing plate 54 between the platen 121 and the upper surface member 521 of the suction casing 52. By contrast, the second suction space 53B forms a space divided by the frame 122 fixed to the right end of the suction casing 52 and the fixing plate 54 between the platen 121 and the upper surface member 521 of the suction casing 52. Volumes of the first suction space 53A and the second suction space 53B are constant without changing according to the width of the work W.

However, in the width direction of the platen 121 (the same direction as the work width direction H2), a suction hole covering ratio, which is a ratio of the suction holes 121H arranged in the range covered with the work W to all the suction holes 121H, changes according to the width of the work W. Therefore, close contact of the work W to the platen 121 might change according to the width of the work W due to suction air generated by the suction device 51 and flowing in the first suction space 53A and the second suction space 53B via the suction holes 121H and the suction openings 521H.

Description will be made, as an example, of two kinds of works W, the wide work W having the first width (e.g. 1900 mm) and the narrow work W having the second width (e.g. 950 mm) which is half the first width.

In a case where in the width direction of the platen 121, the suction hole covering ratio when the wide work W is used is set to be "100%", the suction hole covering ratio when the narrow work W is used is "50%". Here, in the configuration in which the pair of movable boards 53 is omitted, in the width direction of the platen 121, passage of suction air via the suction holes 121H arranged in a range not covered with the work W is not regulated. Therefore, in a case where the suction fan 511 of the suction device 51 is rotated a fixed number of times, when the narrow work W is used, a sucking force obtained by suction air generated by the suction device 51 is half that obtained when the wide work W is used. When a sucking force becomes half, close contact of the work W to the platen 121 is reduced, so that the work W might float up from the platen 121. When the work W is conveyed with the work W floating up from the platen 121, the work W might contact the head unit 21 and resultant adhesion of undesired ink might cause reduction in image quality on the work W.

Under these circumstances, the suction control unit 60 changes a sucking force of the suction device 51 according to a length in the work width direction H2 of the work W (the width of the work W) whose conveyance is guided by the platen 121. For example, in a case where the wide work W having the suction hole covering ratio on the platen 121 of "100%" is used, when the pair of cursors 123 is moved according to the width of the work W, the number of rotations of the fan motor 512 is set to be the first number of rotations (e.g. 6000 rotations). By contrast, in a case where the narrow work W having the suction hole covering ratio on the platen 121 of "50%" is used, when the pair of cursors 123 is moved according to the width of the work W, the number of rotations of the fan motor 512 is changed to the second number of rotations (e.g. 12000 rotations) which is double the first number of rotations.

As described above, in the image forming device 1 configured to omit the pair of movable boards 53, by changing a sucking force of the suction device 51 according to a length in the work width direction H2 of the work W (the width of the work W) whose conveyance is guided by the platen 121, it is possible to make close contact of the work W to the platen 121 constant according to the width of the work W. It is therefore possible to suppress a conveyance failure of the work W such as floating-up from the platen 121 caused by a change of close contact to the platen 121 and resultant reduction in image quality.

While the embodiment of the present disclosure has been described in the foregoing, the present disclosure is not limited thereto and can adopt modified embodiments as follows.

(1) While the above embodiment has been described with respect to the configuration in which in the suction unit 50, the pair of movable boards 53, being fixed to the pair of cursors 123 by the connection member 56, moves in association with the pair of cursors 123, the present disclosure is not limited thereto. The pair of movable boards 53 may be magnetically fixed to the pair of cursors 123 to move in association with the pair of cursors 123. In this case, either one of the movable board 53 or the cursor 123 needs to be formed of a magnet and the other needs to be formed of a magnetic body.

Movement of the pair of movable boards 53 in association with the pair of cursors 123 leads to defining, according to the width of the work W, of the suction spaces 53A and 53B in which suction air flows between the platen 121 and the upper surface member 521 of the suction casing 52. This enables regulation of passage of suction air via the suction hole 121H arranged in a range not covered with the work W in a width direction of the platen 121 (the same direction as the work width direction H2), so that reduction in suction efficiency can be suppressed.

Here, volumes of the suction spaces 53A and 53B defined by the pair of movable boards 53 between the platen 121 and the upper surface member 521 of the suction casing 52 change with movement of the pair of movable boards 53 according to the width of the work W. Therefore, close contact of the work W to the platen 121 changes. Accordingly, a sucking force of the suction device 51 may be changed according to the volume change of the suction spaces 53A and 53B, that is, according to the position of the pair of movable boards 53 in the width direction. This arrangement makes close contact of the work W to the platen 121 constant according to the width of the work W while suppressing the sucking force from becoming excessive, resulting in suppressing a conveyance failure of the work W and reduction in image quality.

(2) While the above embodiment has been described with respect to the configuration in which the pair of movable boards 53 is provided as a board movable between the platen 121 and the upper surface member 521 of the suction casing 52, the present disclosure is not limited thereto. Other than the pair of movable boards 53 fixed to the pair of cursors 123, one or a plurality of other movable boards may be provided. Such other movable board only needs to be connected to the pair of movable boards 53 by, for example, a moving mechanism formed of a combination of a rack and a pinion gear. This enables the other movable board to be moved together with the pair of movable boards 53 in association with the pair of cursors 123.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming device comprising:

an image forming unit to form an image on a predetermined work;

a conveyance unit to convey the work in a predetermined conveyance direction toward the image forming unit;

a conveyance guide member having a plate shape with a predetermined length in a work width direction orthogonal to the conveyance direction of the work, suction holes provided over an entire region of the conveyance guide member in the work width direction, and the conveyance guide member guiding conveyance of the work by the conveyance unit from below;

a pair of cursors movable in the work width direction on the conveyance guide member and positioning the work in the work width direction as the work is being guided by the conveyance guide member;

a suction unit arranged below the conveyance guide member, the suction unit including:

a suction casing having a box shape with an upper surface member to be covered by the conveyance guide member from an upper side and a suction opening being formed in the upper surface member, a suction device arranged in the suction casing and generating suction air by sucking air in a space on an upper side of the conveyance guide member via the suction opening and the suction holes, the suction air causing the work to closely contact the conveyance guide member; and a pair of movable boards provided between the conveyance guide member and the upper surface member, the movable boards being movable in the work width direction in association with the pair of cursors, the movable boards defining a suction space between the conveyance guide member and the upper surface member, the suction space being a space through which the suction air flows via the suction holes and the suction opening; and a suction control unit to change a sucking force of the suction device according to a length in the work width direction of the work guided by the conveyance guide member, wherein:

the suction device has a suction fan that generates the suction air through rotation; and the suction control unit changes a sucking force of the suction device by controlling a number of rotations of the suction fan per unit time, depending on a ratio of the suction holes arranged in a range covered by the work to all of the suction holes.

2. An image forming device, comprising:

an image forming unit to form an image on a predetermined work;

a conveyance unit to convey the work in a predetermined conveyance direction toward the image forming unit;

a conveyance guide member having a plate shape with a predetermined length in a work width direction orthogonal to the conveyance direction of the work, suction holes provided over an entire region of the conveyance guide member in the work width direction and the conveyance guide member guiding conveyance of the work by the conveyance unit from below;

a suction unit including:

a suction casing having a box shape with an upper surface member to be covered by the conveyance guide member from an upper side, a suction opening formed in the upper surface member, a suction device arranged in the suction casing at a position below the conveyance guide member, the suction device generating suction air by sucking air in a space on the upper side of the conveyance guide member via the suction holes and the suction opening, the suction air causing the work to closely contact the conveyance guide member, and two movable boards provided between the conveyance guide member and the upper surface member so as to be movable in the work width direction, the movable boards defining a suction space between the conveyance guide member and the upper surface member, the suction space being a space through which the suction air flows via the suction holes and the suction opening; and a suction control unit to change a sucking force of the suction device according to a length in the work width direction of the work guided by the conveyance guide member, the suction control unit changes a sucking force of the suction device based on a position of the two movable boards in the work width direction, wherein:

the suction device has a suction fan that generates the suction air through rotation; and the suction control unit changes a sucking force of the suction device by controlling a number of rotations of the suction fan per unit time, depending on a ratio of the suction holes arranged in a range covered by the work to all of the suction holes.

3. An image forming device, comprising:

an image forming unit to form an image on a predetermined work;

a conveyance unit to convey the work in a predetermined conveyance direction toward the image forming unit;

a conveyance guide member having a plate shape with a predetermined length in a work width direction orthogonal to the conveyance direction of the work, suction holes provided over an entire region of the conveyance guide member in the work width direction, and the conveyance guide member guiding conveyance of the work by the conveyance unit from below;

a pair of cursors movable in the work width direction on the conveyance guide member and positioning the work in the work width direction, the work being guided by the conveyance guide member;

a suction unit that includes:

a suction casing having a box shape with an upper surface member to be covered by the conveyance guide member from an upper side, a suction opening formed in the upper surface member, a suction device arranged in the suction casing and below the conveyance guide member, the suction casing generating suction air by sucking air in a space on an upper side of the conveyance guide member via the suction holes and the suction opening, and a frame fixedly defining a suction space between the conveyance guide member and the upper surface member, the suction space being a space through which the suction air flows via the suction holes and the suction opening; and a suction control unit to change a sucking force of the suction device according to a length in the work width direction of the work guided by the conveyance guide member, the suction control unit changing a sucking force of the suction device based on a position of the pair of cursors on the conveyance guide member in the work width direction, wherein:

the suction device has a suction fan that generates the suction air through rotation; and the suction control unit changes a sucking force of the suction device by controlling a number of rotations of the suction fan per unit time, depending on a ratio of the suction holes arranged in a range covered by the work to all of the suction holes.

* * * * *